US008253363B2

(12) United States Patent
Shih

(10) Patent No.: US 8,253,363 B2
(45) Date of Patent: Aug. 28, 2012

(54) AUTOMATIC OPENING-AND-CLOSING LID FOR GARBAGE BIN

(75) Inventor: Tsung-Hwan Shih, Kaohsiung (TW)

(73) Assignee: THN Shong Industrial Co., Ltd., Taichung Hsien (TW)

( * ) Notice: Subject to any disclaimer, the term of this patent is extended or adjusted under 35 U.S.C. 154(b) by 472 days.

(21) Appl. No.: 12/547,544

(22) Filed: Aug. 26, 2009

(65) Prior Publication Data

US 2011/0049149 A1 Mar. 3, 2011

(51) Int. Cl.
*G05B 5/00* (2006.01)

(52) U.S. Cl. ..... 318/445; 318/16; 318/480

(58) Field of Classification Search ..... 318/445, 318/16, 480, 280, 286; 220/260
See application file for complete search history.

(56) References Cited

U.S. PATENT DOCUMENTS

2007/0209846 A1* 9/2007 Wilson ..... 180/65.1
2008/0084289 A1* 4/2008 White et al. ..... 340/449
* cited by examiner

*Primary Examiner* — Karen Masih
(74) *Attorney, Agent, or Firm* — Kamrath IP Lawfirm; Alan Kamrath

(57) ABSTRACT

An automatic opening-and-closing lid for a garbage bin includes a base member including an opening for a user throwing trash into the bin therefrom and first and second annular flanges. A lid is installed to the opening of the base member and is able to pivot with respect to the base member. A control is installed to the base member and includes a power source for power supply, a control panel, a driving member electrically connected to the control panel, a driven member and first and second sensor wires electrically connected to the power source. The first and second sensor wires are respectively disposed in the first and second annular flanges. A sensing region is formed proximal to the first and second sensor wires.

13 Claims, 11 Drawing Sheets

AUTOMATIC OPENING-AND-CLOSING LID FOR GARBAGE BIN

BACKGROUND OF THE INVENTION

Field of the Invention

The present invention relates to an automatic opening-and-closing lid for a garbage bin and, more particularly, to a static-control automatic opening-and-closing lid for a garbage bin.

SUMMARY OF THE INVENTION

According to the present invention, an automatic opening-and-closing lid for a garbage bin includes a base member, a lid member, a lid and a control. The control includes first and second sensor wires and the two sensor wires define a sensing region. There is a drop height between the first and second sensor wires so that the sensing region can provide a great effect.

Other objectives, advantages, and features of the invention will become more apparent from the following detailed description when taken in conjunction with the accompanying drawings.

DETAILED DESCRIPTION OF THE EMBODIMENTS

Figure 1:
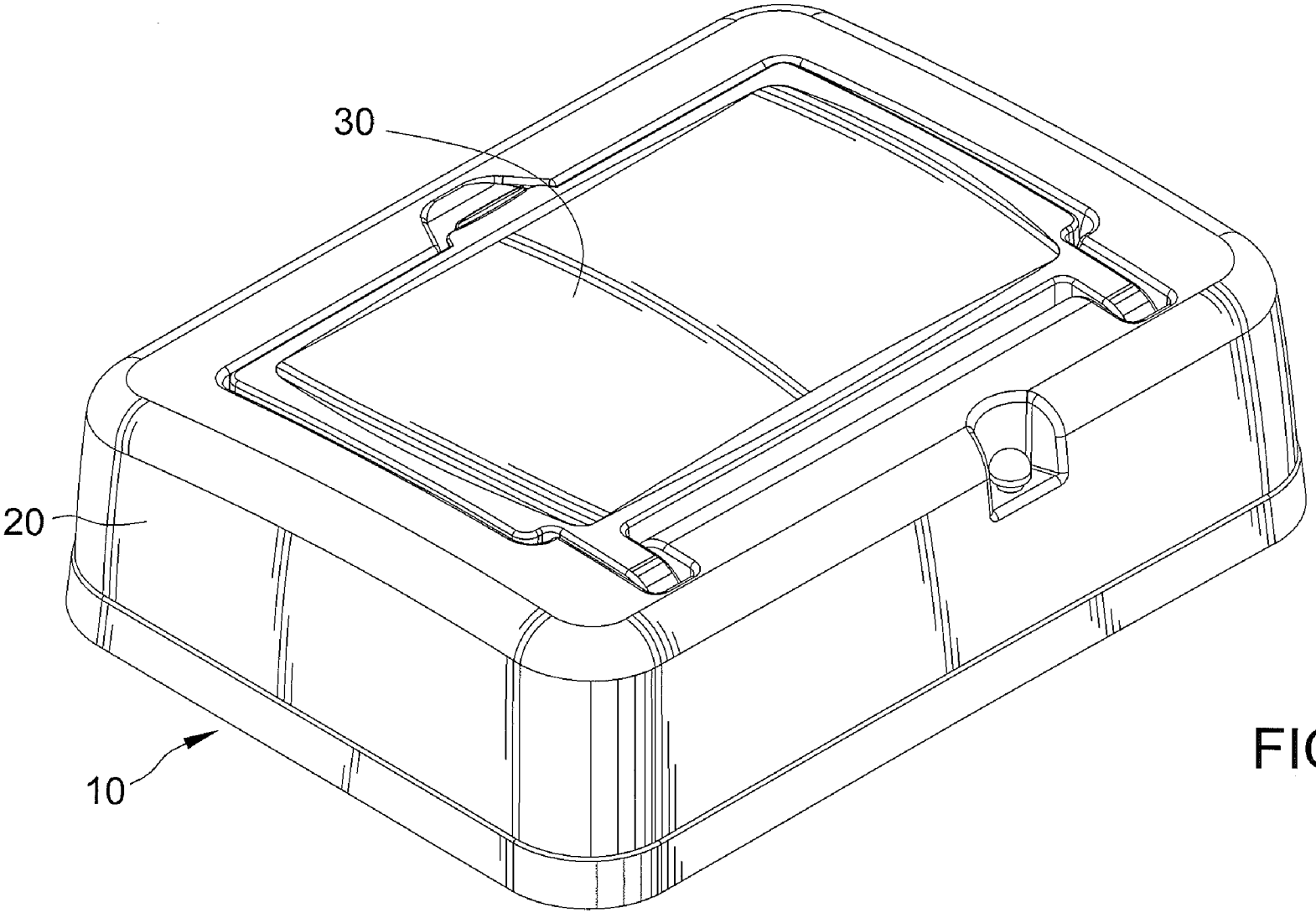
FIG. 1 is a perspective view of an automatic opening-and-closing lid for a garbage bin according to the preferred embodiment of the present invention.
Figure 2:
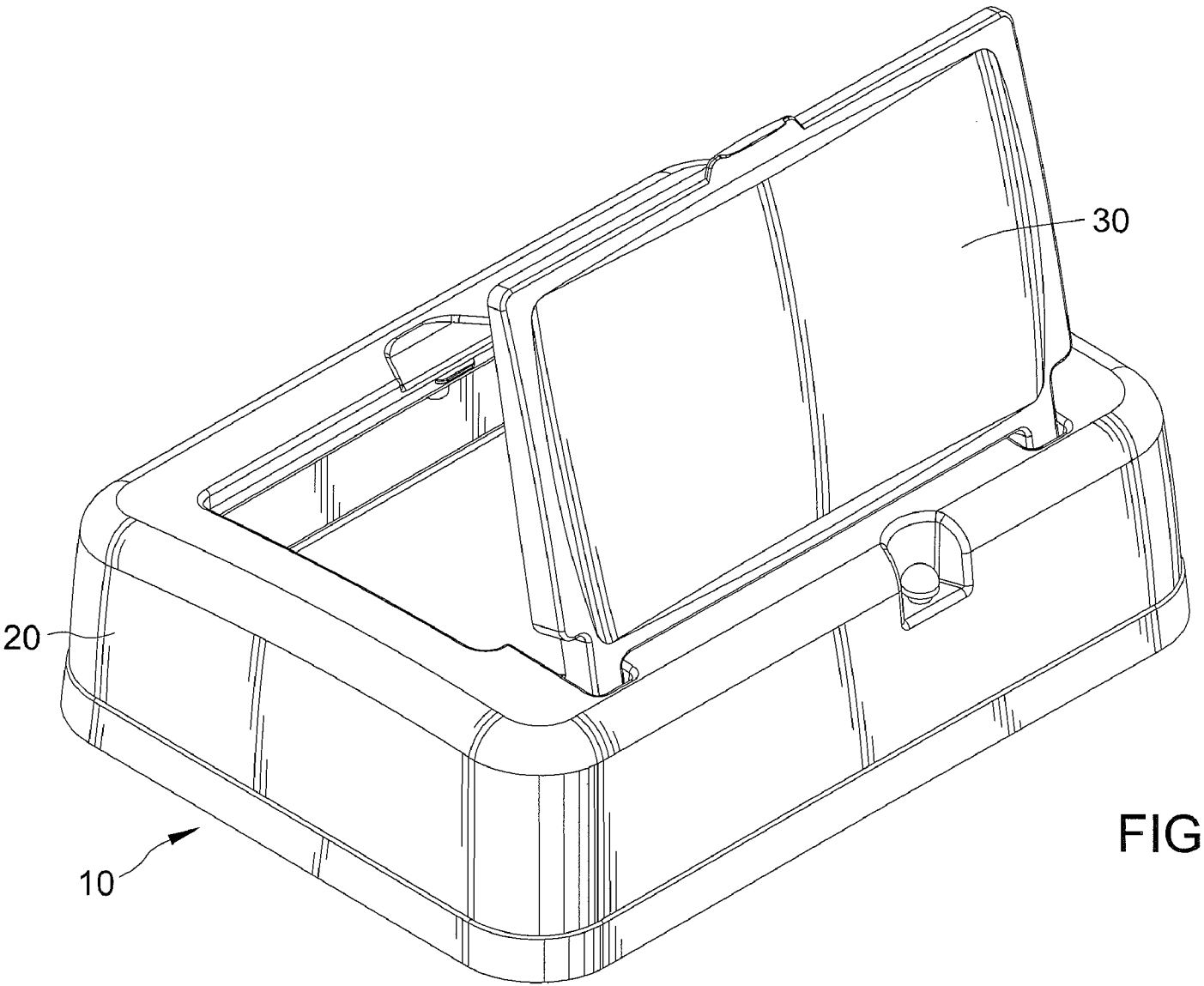
FIG. 2 is another perspective view of the automatic opening-and-closing lid shown in FIG. 1.
Figure 3:
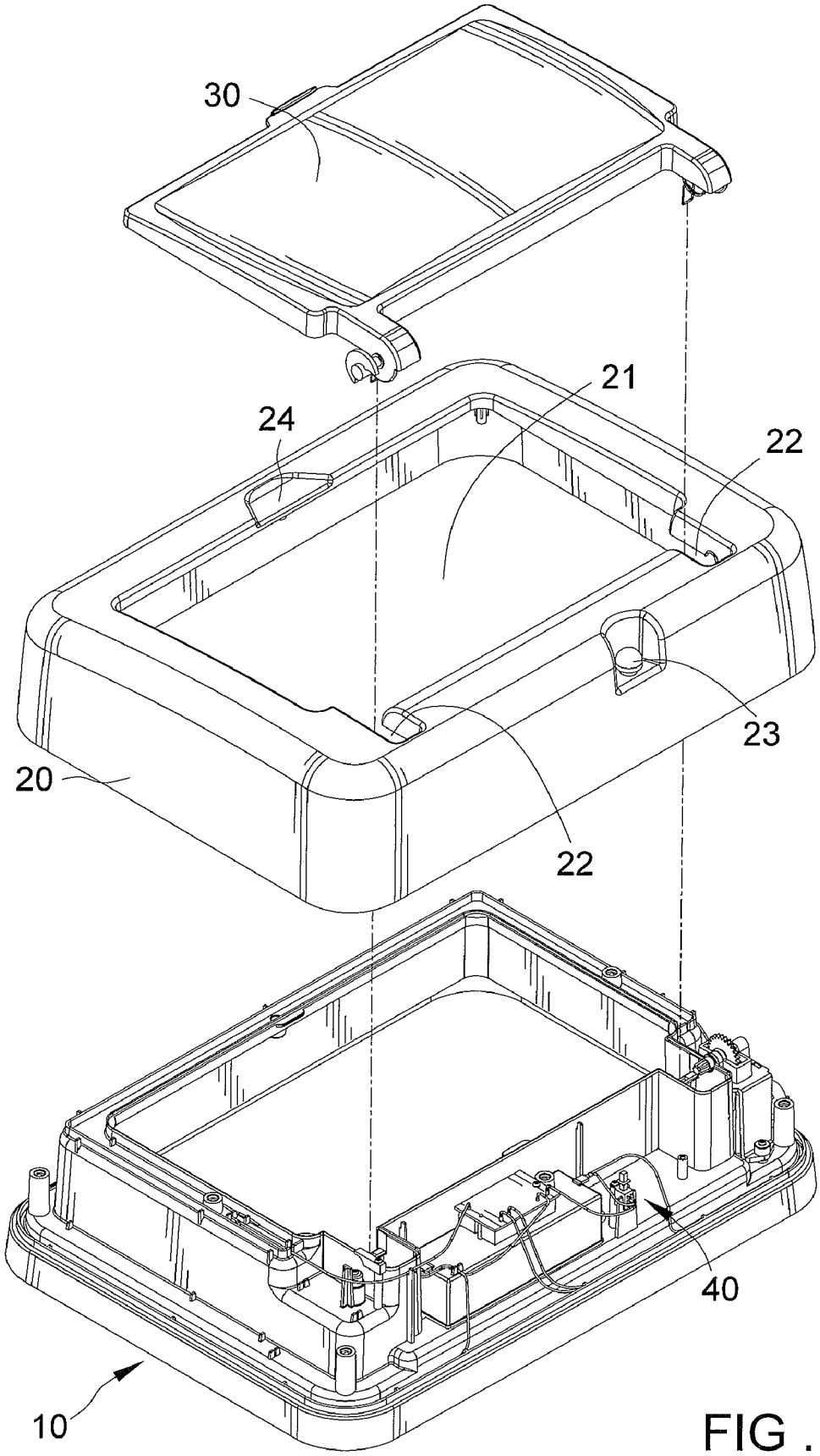
FIG. 3 is an exploded perspective view of the automatic opening-and-closing lid shown in FIG. 1.

FIGS. 1 through 5 show an automatic opening-and-closing lid for a garbage bin in accordance with the preferred embodiment of the present invention. The automatic opening-and-closing lid includes a base member 10, a lid member 20, a lid member 30 and a control 40. The lid member 20 is mounted on the base member 10 and prevents the base member 10 from being exposed. The lid member 30 is pivotally installed onto the base member 10 and can automatically open/close by controlling the control 40.

The base member 10 has a first side 101 and a second side 102, and an opening 11 is defined between the first and second sides 101 and 102 and allows users to throw garbage into the garbage bin therefrom. Two receptacles 12 are formed at the first side 101 and respectively communicate with the opening

11. An abutted portion 121 is provided in each receptacle 12, and two ends of the abutted portion 121 are respectively abutted with two inner sides of the related receptacle 12. A receiving portion 122 is formed on the center of each abutted portion 121. A space 13 and first and second annular flanges 14 and 15 are defined at the periphery of the opening 11, and the space 13 is provided between the two receptacles 12. The first and second annular flanges 14 and 15 causes the periphery of the opening 11 to be stepped, and a horizontal position of the first annular flange 14 is higher than that of the second annular flange 15. A horizontal position of the bottom of the space 13 is substantially equal to that of the second annular flange 15. A plurality of coupled columns 16 is disposed on the periphery of the opening 11 and at the corners of the base member 10 for coupling the base member 10 to the lid member 20. A limiting portion 17 is provided at the first annular flange 14 and proximal to one of the receptacles 12.

The lid member 20 includes an opening 21 formed on the center thereof and two receptacles 22 defined at a side thereof and in communication with the opening 21. The opening 21 corresponds to the opening 11, and the receptacles 22 respectively correspond to the receptacles 12. A touch portion 23 and a blocked portion 24 are respectively provided at two sides of the periphery of the lid member 20, and the touch portion 23 is proximal to the receptacles 22.

The lid 30 is installed between the openings 11 and 21 of the base member 10 and the lid member 20 and is able to pivot with respect to the base member 10 and the lid member 20. A first pivotal ear 31 and a second pivotal ear 32 are respectively formed on two ends of a side of the lid 30. Two elastic elements 33 are pivotally connected to the first and second pivotal ears 31 and 32 respectively. A pivoting portion 321 projects from a side of the second pivotal ear 32 opposite to the first pivotal ear 31 and is formed with first and second blocked sections 322 and 323 selectively abutting against the limiting portion 17. The first and second pivotal ears 31 and 32 are installed to the receptacles 12 and 22 of the base 10 and the lid 20 members and abut with the abutted portions 121. Each elastic element 33 has a leg abutted with the inner wall of the related one of the first and second pivotal ears 31 and 32 and the other leg inserted into the receiving portion 122 of the related one abutted portion 121. A lug 34 extends outwardly from the middle of the other side of the lid 30 opposite to the first and second pivotal ears 31 and 32 and is selectively disposed in the blocked portion 24 of the lid member 20.

The control 40 is set in the base member 10 and includes a power source 41 having a positive port 411 and a negative port 412, a control panel 42 disposed above the power source 41, a switch member 43, a driving member 44, a driven member 45 and first and second sensor wires 46 and 47. The power source 41, the switch member 43 and the driving member 44 are stored in the space 13. The switch member 43 corresponds to the touch portion 23 of the lid member 20 so that users can operate the touch portion 23 to drive the switch member 43 for choosing between lifting the lid 30 manually or automatically by static-control. The control panel 42 is adapted to electrically connect the power source 41 to the switch member 43, and a static signal is transmitted to the control panel 42 via the first and second sensor wires 46 and 47 to drive the driving member 44 to rotate. Then, the driven member 45 is driven by the driving member 44 and includes an axle 451 inserted through a driven hole 311 of the first pivotal ear 31 so that the axle 451 can drive the driven hole 311 to rotate for lifting the lid 30.

Figure 6:
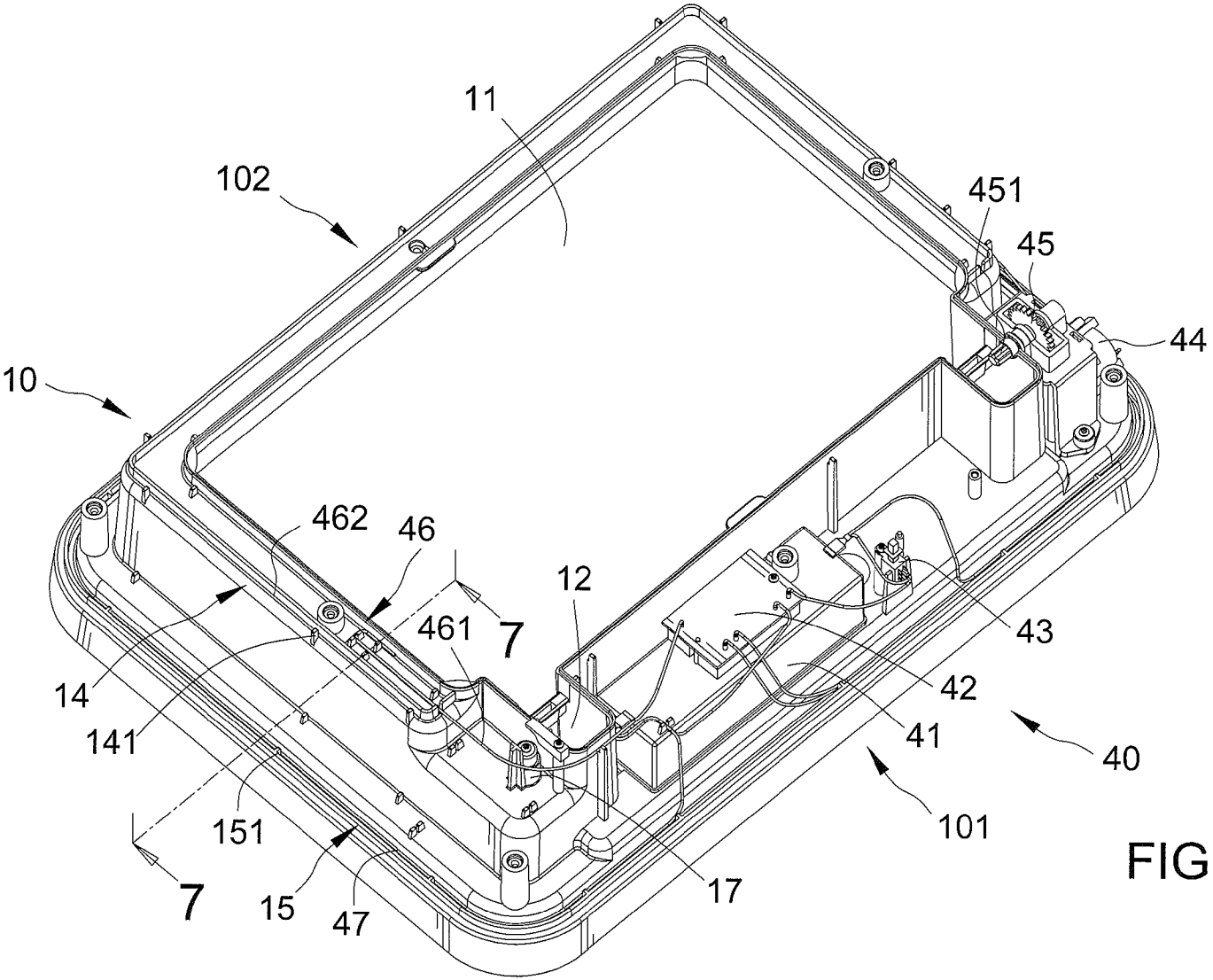
FIG. 6 shows a combination of a control and a base member of the automatic opening-and-closing lid shown in FIG. 1.

Referring to FIG. 6, the first sensor wire 46 has a first section 461 having a first end and a second end and a second section 462 having a first end and a second end. The first end of the first 461 is connected to the control panel 42, the first end of the second section 462 is connected to the positive port 411 of the power source 41 and the second ends of the first and second sections 461 and 462 are coupled to each other. The first sensor wire 46 is annularly disposed around the base member 10 and provided in the first annular flange 14. An end of the second sensor wire 47 is electrically connected to the negative port 412. The second sensor wire 47 is annularly disposed around the base member 10 and provided in the second annular flange 15. The positive port 411 is electrically connected to the switch member 43, and the switch member 43 is electrically connected to the control panel 42.

Figure 7:
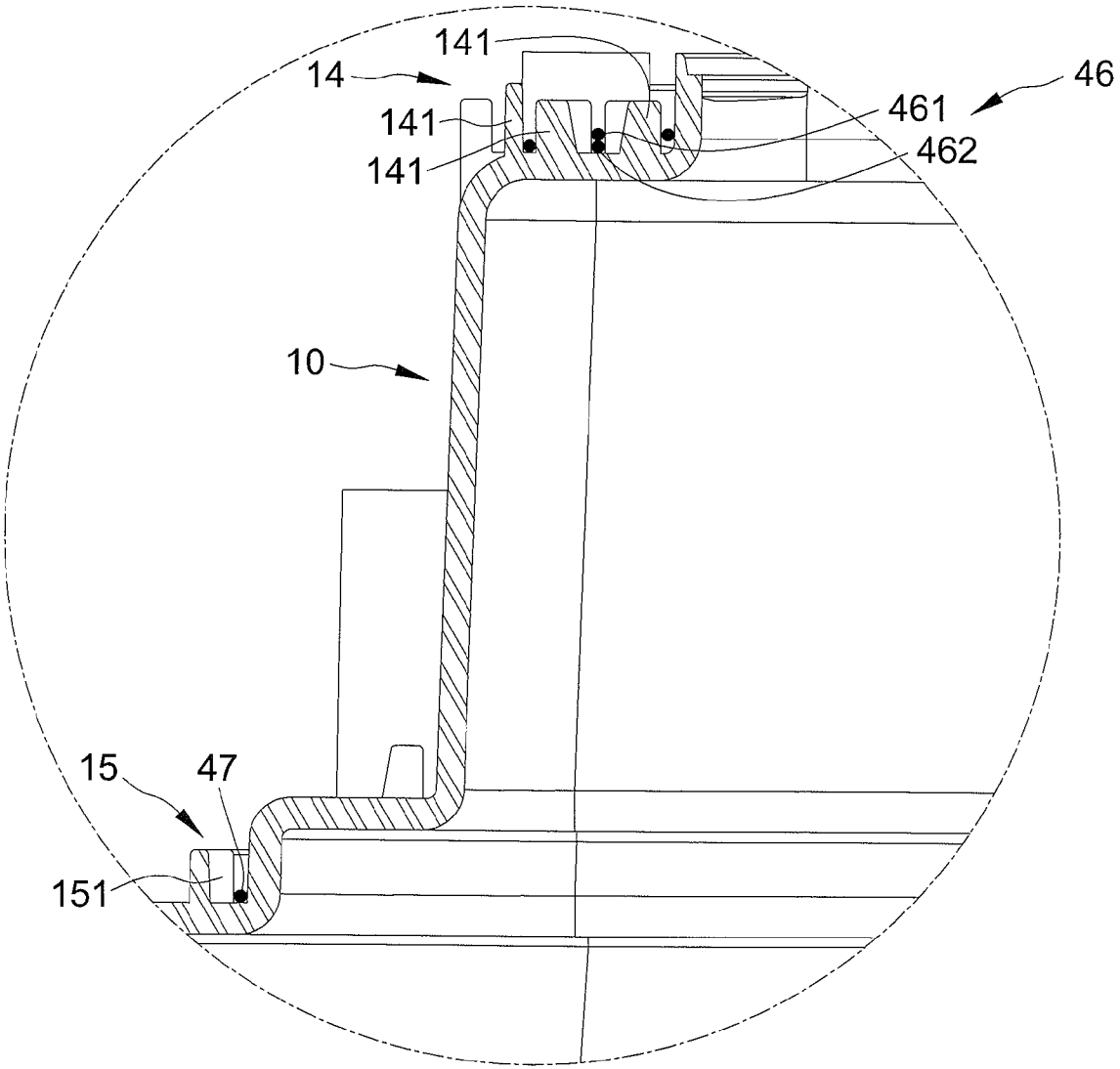
FIG. 7 is a cross-sectional view taken along line 7-7 in FIG. 6.

Referring to FIG. 7, a plurality of projections 141 and 151 is respectively provided at the first and second annular flanges 14 and 15 and prevent the first and second sensor wires 46 and 47 from detaching from the first and second annular flanges 14 and 15 automatically. The first and second sections 461 and 462 of the first sensor wire 46 are coupled to each other.

Figure 8:
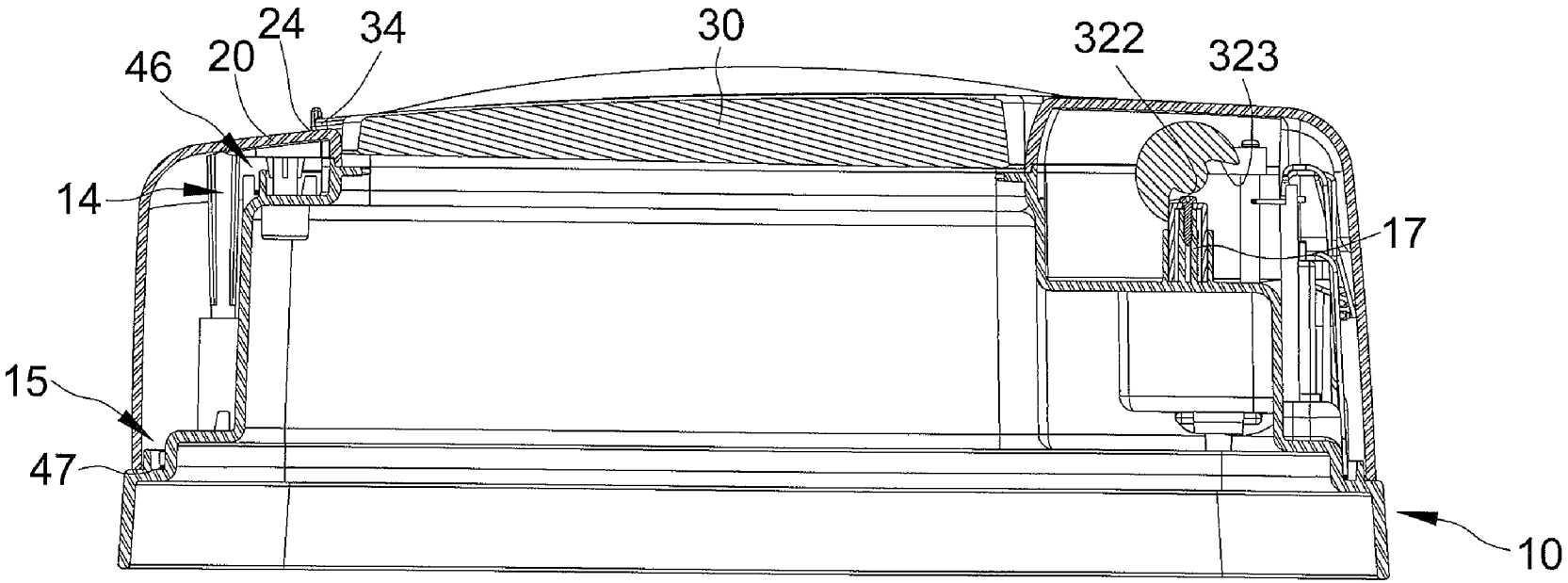
FIG. 8 is a cross-sectional view of the automatic opening-and-closing lid shown in FIG. 1.
Figure 9:
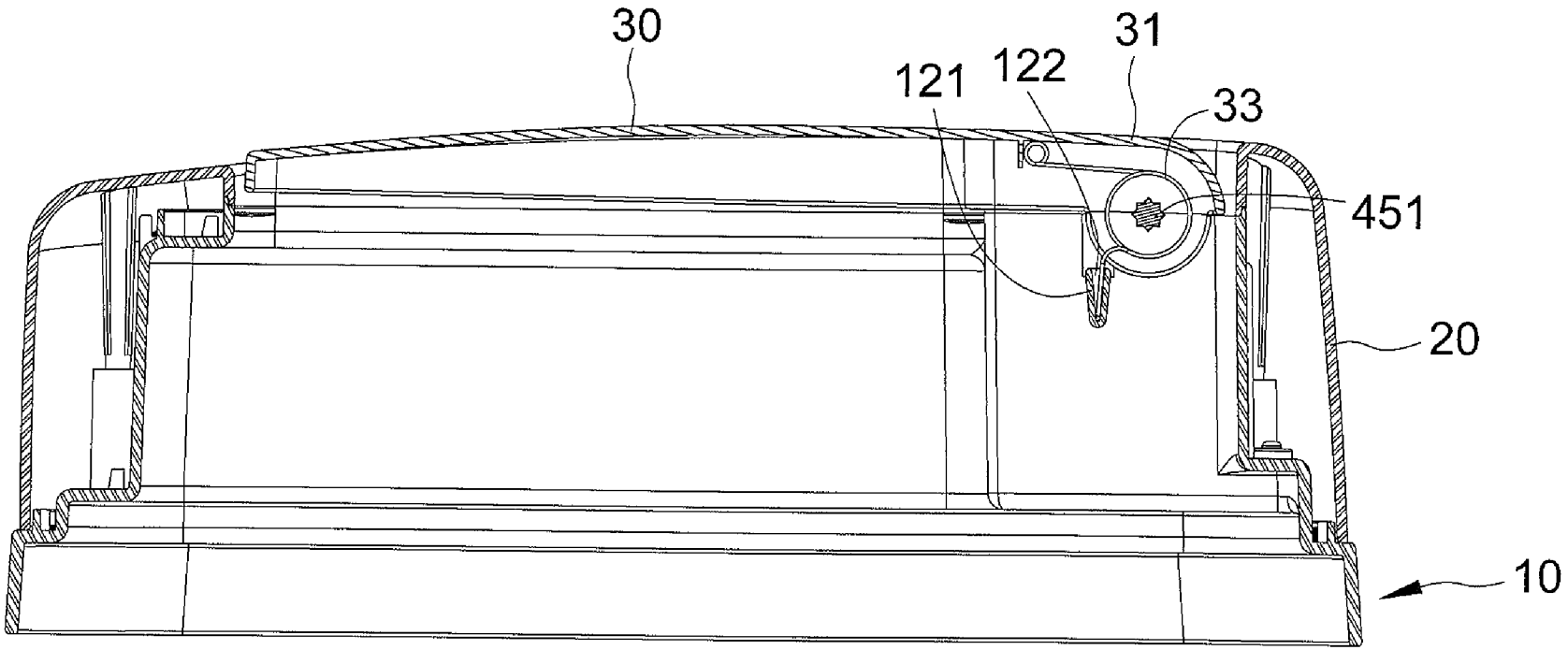
FIG. 9 is a cross-sectional view similar to FIG. 8.

Referring to FIGS. 8 and 9, the automatic opening-and-closing lid of the present invention is closed in a normal condition. Each elastic element 33 has a leg abutted with the inner wall of the related one of the first and second pivotal ears 31 and 32 and has the other leg inserted into the receiving portion 122 of the related one abutted portion 121. In this embodiment, the elastic element 33 is in the form of a torque spring. The first blocked section 322 of the second pivotal ear 32 is abutted with the limiting portion 17 of the base member 10. The lug 34 is disposed in the blocked portion 24 of the lid member 20. The driving member 44 drives the driven member 45 to rotate (shown in FIG. 4). The driven member 45 further drives the lid 30 to close the openings 11 and 21 of the base and lid members 10 and 20. In the meanwhile, the weight of the lid member 20 and the rotational force of the driving member 44 are larger than the elastic force of the elastic elements 33 so that the lid 30 is able to overcome the elastic elements 33 and is maintained in the close position.

Figure 10:
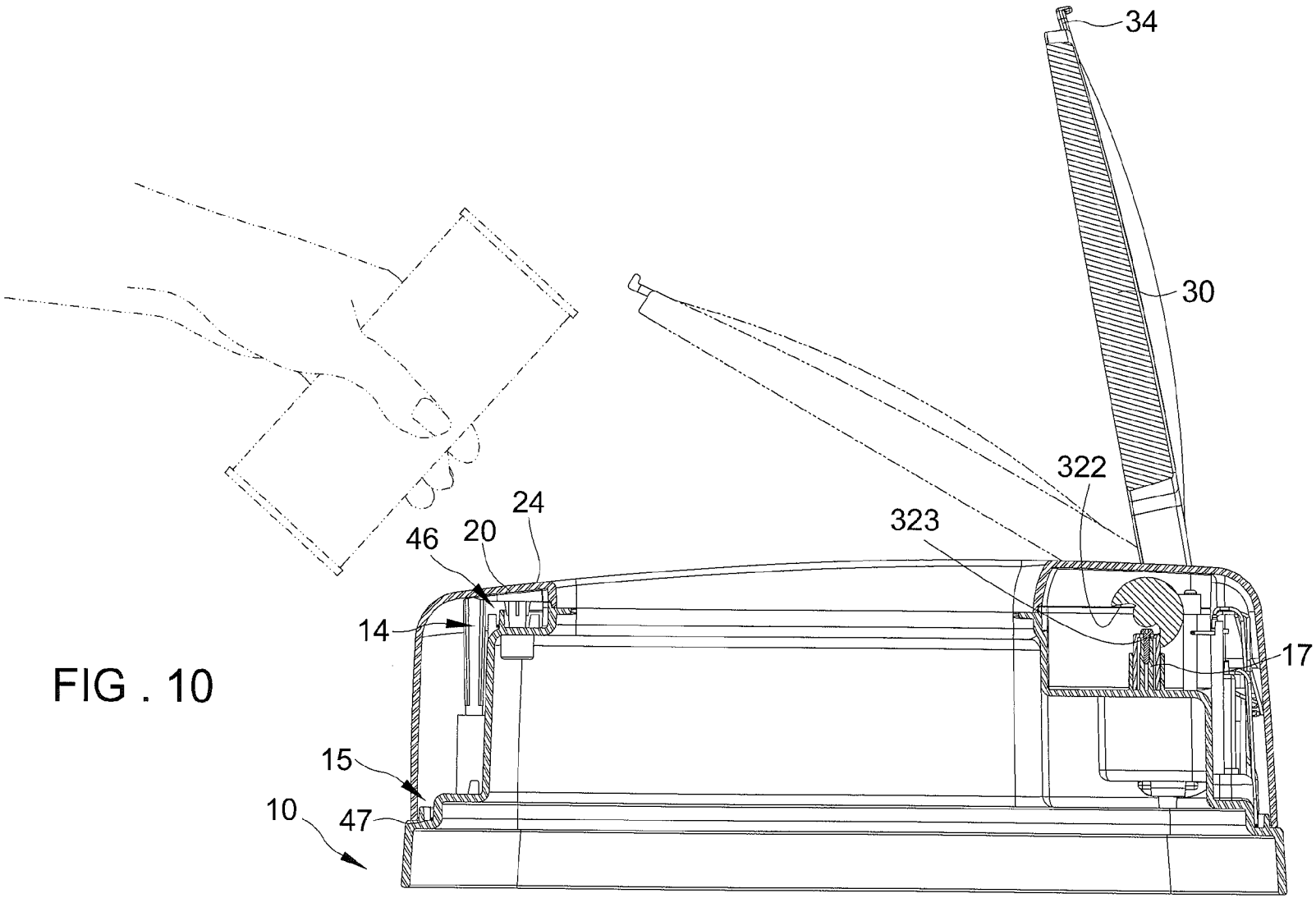
FIG. 10 is another cross-sectional view of the automatic opening-and-closing lid shown in FIG. 1.
Figure 11:
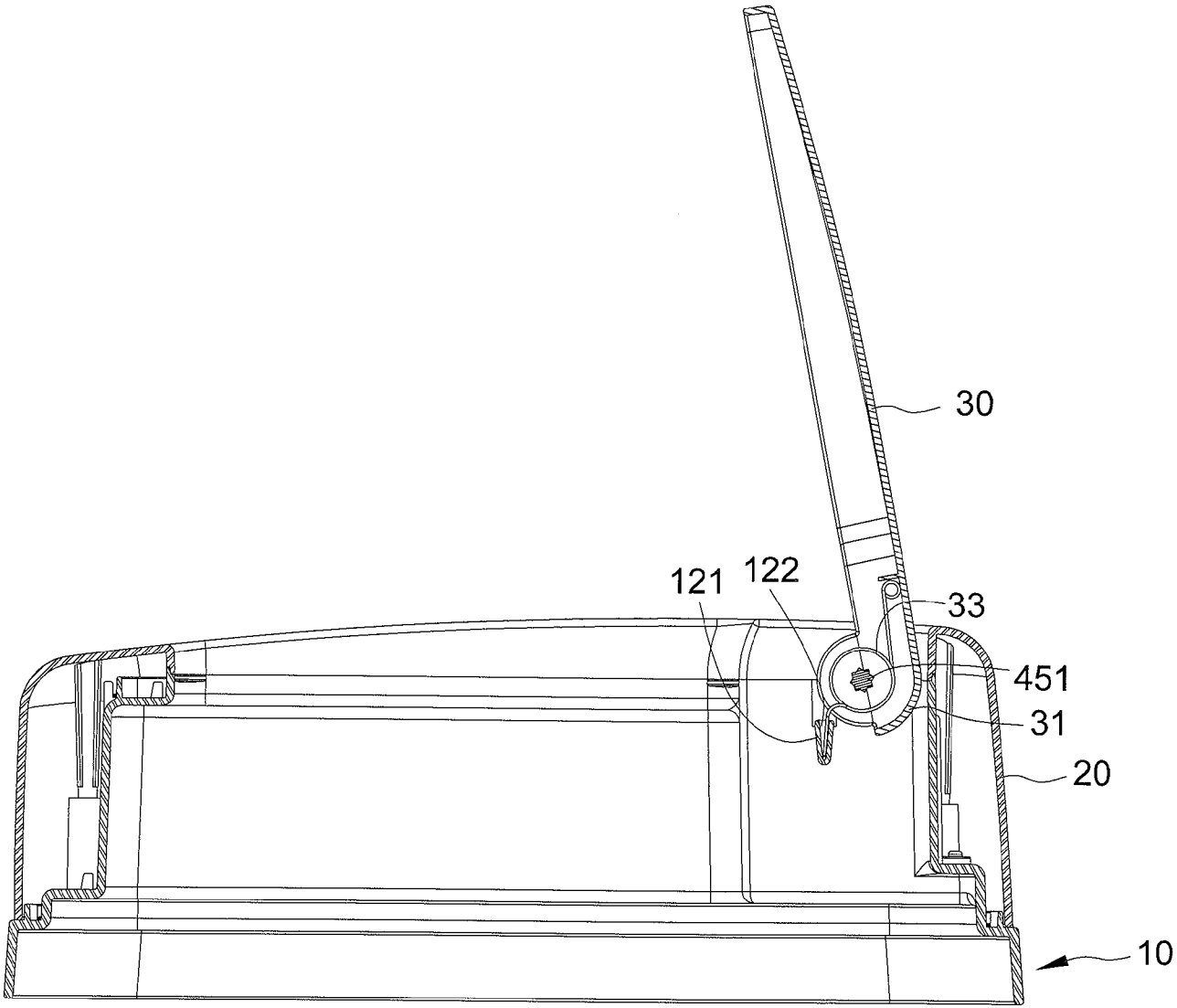
FIG. 11 is a cross-sectional view similar to FIG. 10.

Referring to FIGS. 10 and 11, the first and second sensor wires 46 and 47 are disposed in the first and second annular flanges 14 and 15 respectively. Because of a drop height which is defined between the first and second annular flanges 14 and 15, there's a drop height defined between the first and second sensor wires 46 and 47. A sensing region is provided around the first and second sensor wires 46 and 47. A horizontal position of the first sensor wire 46 is higher than that of the second sensor wire 47 so that the sensing region could be larger than that of a conventional static-control lid for achieving a greater sensor effect. Thus, users do not need to close the garbage bin excessively. Further, the first and second sensor wires 46 and 47 are annularly disposed around the base member 10 so that users can throw garbage into the garbage bin from any direction, and the lid 30 can be driven to life via static-control.

Figure 4:
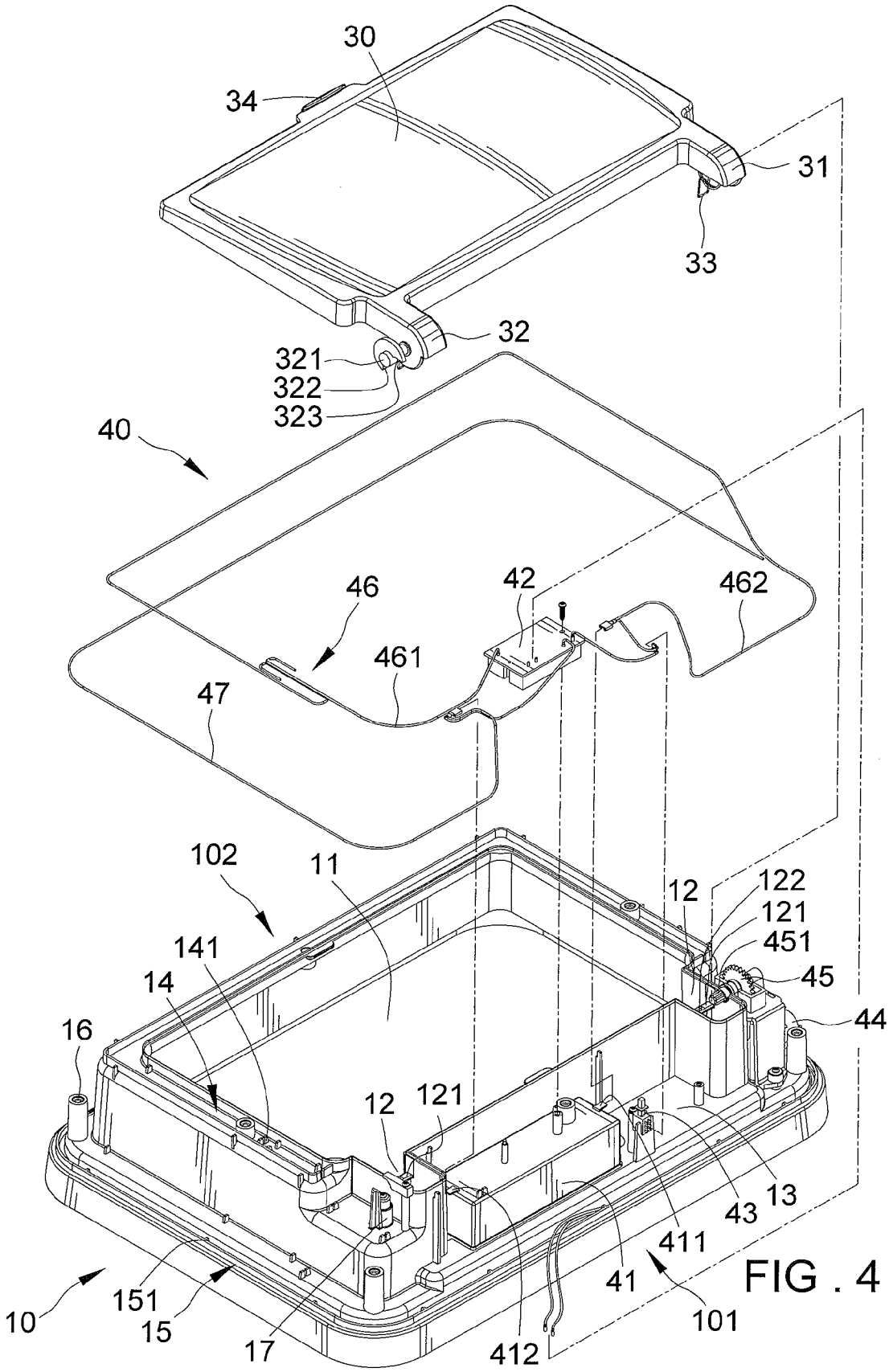
FIG. 4 is a partial, exploded perspective view of the automatic opening-and-closing lid shown in FIG. 1.
Figure 5:
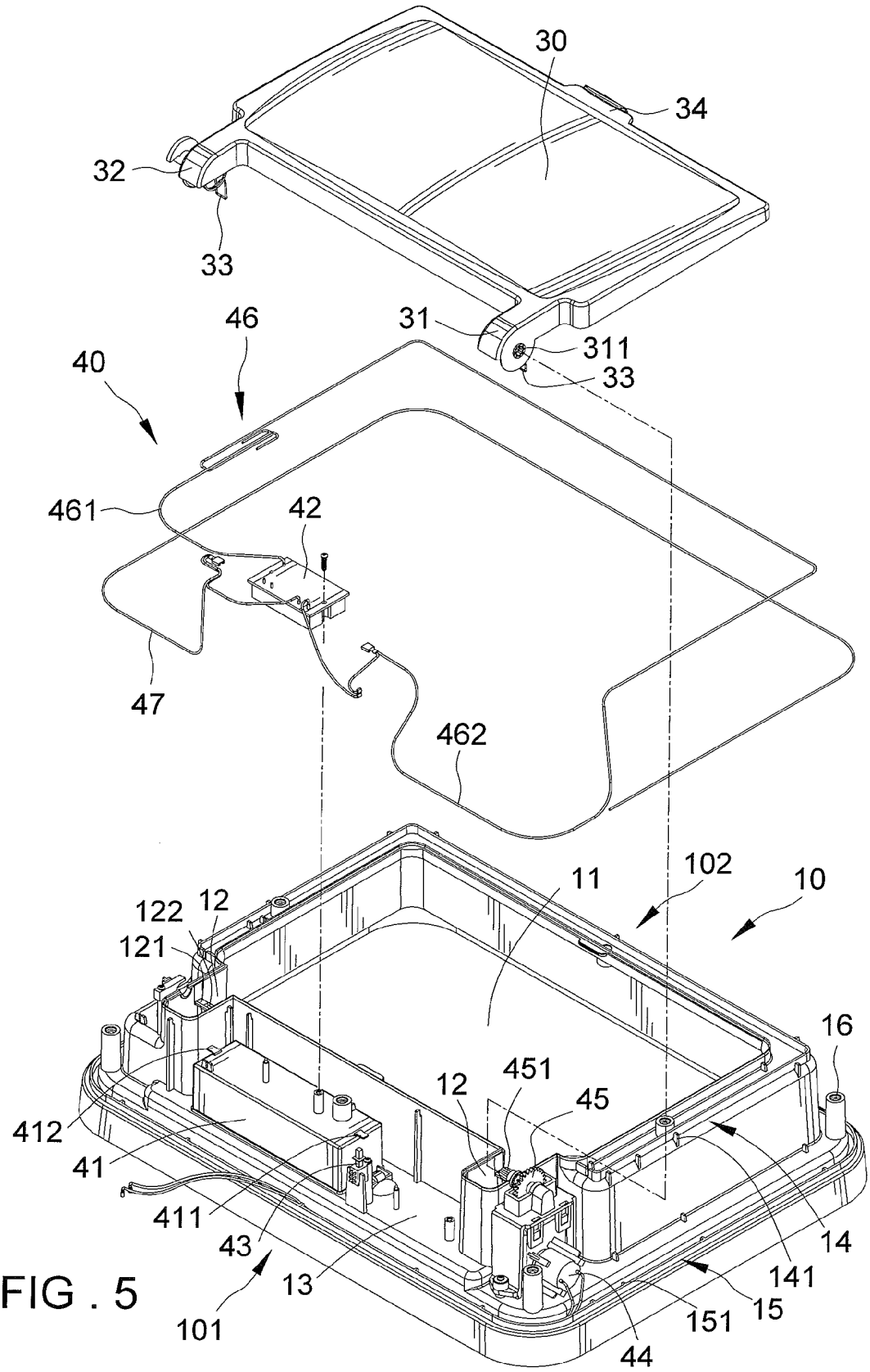
FIG. 5 is another partial, exploded perspective view of the automatic opening-and-closing lid shown in FIG. 1.

Further referring to FIG. 4, if users are close to the garbage bin for throwing garbage, the balance-magnetic sensing region is interfered by static of the users. Then, the control panel 42 receives a signal from the sensing region. The control panel 42 controls the driving member 44 to drive the driven member 45 to rotate. Thus, the driven member 45 drives the lid 30 to pivot so that the lid 30 is lifted. While the driven member 45 is rotated, the elastic elements are released to lift the lid 30 with respect to the base and lid members 10 and 20. The elastic element 33 connected to the axle 451 assists the axle 451 to rotate. Thus, the driving member 44 does not need to output excess torque for reducing rotation loading of the driving member 44 and extending the service life of the driving member 44. It can prevent the driven member 45 from getting broken teeth under excessive torque. While lifting the lid 30, the second pivotal ear 32 is pivoted with respect to the base member 10, and the second blocked section 323 is abutted with the limiting portion 17 and restricts the lid 30 from continuing to rotate, so that the lid 30 can be positioned to a predetermined position.

The control panel 42 is adapted to set the time for maintaining the lid 30 open, so that users can throw garbage into the bin from the openings 11 and 21 during this time. Till time is up, the driving member 44 would drive the driven member 45 to rotate for controlling the lid 30 to close the openings 11 and 21.

While several embodiments of the invention have been shown and described, it will be apparent to those skilled in the art that modifications may be made therein without departing from the scope and spirit of the present invention.

What is claimed is:

1. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed in the first and second annular flanges; and a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member, with a drop height defined between the first and second annular flanges, and with a horizontal position of the first annular flange higher than that of the second annular flange.

2. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed the first and second annular flanges; and a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member, with the first and second annular flanges formed on a periphery of the opening of the base member.

3. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed in the first and second annular flanges; and a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member, wherein the power source includes a positive port and a negative port and the first sensor wire has a first section having a first end and a second end and a second section having a first end and a second end, with the first end of the first sensor wire connected to the control panel, with the first end of the second sensor wire connected to the positive port of the power source, and with the second ends of the first and second sensor wires coupled to each other.

4. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed in the first and second annular flanges; and a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member, wherein the power source includes a positive port and a negative port, with an end of the second sensor wire electrically connected to the negative port.

5. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed in the first and second annular flanges;

a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member; and an elastic element provided between the lid and the base member and assisting the driven member to rotate.

6. The automatic opening-and-closing lid as claimed in claim 5 further comprising a first pivotal ear having a driven hole and a second pivotal ear respectively formed on two ends of a side of the lid; wherein the driven member includes an axle inserted through the driven hole of the first pivotal ear with the axle driving the driven hole to rotate for lifting the lid.

7. The automatic opening-and-closing lid as claimed in claim 6 further comprising two receptacles formed at a side of the base member and respectively communicating with the opening, with each receptacle formed with an abutted portion, with two ends of the abutted portion respectively abutted with two inner sides of the related receptacle; wherein each elastic element has a leg abutted with the inner wall of the related one of the first and second pivotal ears and another leg inserted into the receiving portion of the related abutted portion.

8. The automatic opening-and-closing lid as claimed in claim 7 further comprising a limiting portion provided at the first annular flange and proximal to one of the receptacles and a pivoting portion projecting from a side of the second pivotal ear opposite to the first pivotal ear and forming first and second blocked sections selectively abutted against the limiting portion.

9. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed in the first and second annular flanges;

a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member; and a lid member installed to the base member and including an opening formed on a center thereof and two receptacles defined at a side thereof and in communication with the opening; wherein the opening of the lid member corresponds to the opening of the base member and the receptacles of the lid member respectively correspond to the receptacles of the base member.

10. The automatic opening-and-closing lid as claimed in claim 9 further comprising a blocked portion provided at the periphery of the lid member and a lug extending outwardly from a middle of a side of the lid opposite to the first and second pivotal ears and selectively disposed in the blocked portion of the lid member.

11. The automatic opening-and-closing lid as claimed in claim 10 wherein the control includes a switch member for choosing between lifting the lid manually or automatically by static-control.

12. An automatic opening-and-closing lid for a garbage bin comprising:

a base member including an opening for a user throwing trash into the bin therefrom and first and second annular flanges;

a lid installed to the opening of the base member and able to pivot with respect to the base member;

a control installed to the base member and including a power source for power supply, a control panel, a driving member electrically connected to the control panel, a driven member and first and second sensor wires electrically connected to the power source, with the first and second sensor wires respectively disposed in the first and second annular flanges;

a sensing region formed proximal to the first and second sensor wires;

wherein while the sensing region receives a static signal, the first and second sensor wires transmit the signal to the control panel and the control panel controls the driving member to drive the driven member to rotate for driving the lid to lifting or closing the opening of the base member; and a plurality of projections respectively provided at the first and second annular flanges and preventing the first and second sensor wires from detaching from the first and second annular flanges automatically.

13. The automatic opening-and-closing lid as claimed in claim 12 further comprising a space defined at the periphery of the opening and provided between the two receptacles, with the power source and the driving member received in the space.

* * * * *